United States Patent [19]

Bonnardel

[11] Patent Number: 4,810,343

[45] Date of Patent: Mar. 7, 1989

[54] INSTALLATION FOR CARRYING OUT LOCALIZED ELECTROLYTIC SURFACE TREATMENTS

[75] Inventor: Roland Bonnardel, Verneuil en Halatte, France

[73] Assignee: Selectrons Ltd., Waterbury, Conn.

[21] Appl. No.: 3,521

[22] Filed: Jan. 15, 1987

[30] Foreign Application Priority Data

Jan. 16, 1986 [FR] France ..... 86 00563

[51] Int. Cl.[4] ..... C25D 17/14; C25F 3/16; C25F 7/00

[52] U.S. Cl. ..... 204/224 R; 204/224 M; 204/271; 204/278

[58] Field of Search ..... 204/224 R, 271, 279, 204/278, 237

[56] References Cited

U.S. PATENT DOCUMENTS

| | | | |
|---|---|---|---|
| 2,859,157 | 11/1958 | Curtiss, Jr. | 204/237 X |
| 3,546,088 | 12/1970 | Barkman et al. | 204/224 R |
| 3,751,343 | 8/1973 | Macula et al. | 204/224 R X |
| 3,819,329 | 6/1974 | Kaestner et al. | 204/271 X |
| 3,974,042 | 8/1976 | Angelini | 204/224 R X |
| 4,001,094 | 1/1977 | Jumer | 204/224 R X |
| 4,318,786 | 3/1982 | Lahoda et al. | 204/224 R X |
| 4,348,267 | 9/1982 | Shimamura | 204/237 X |
| 4,486,279 | 12/1984 | Fromson et al. | 204/212 X |
| 4,632,740 | 12/1986 | Operschall et al. | 204/224 R X |

*Primary Examiner*—Donald R. Valentine
*Attorney, Agent, or Firm*—Larson & Taylor

[57] ABSTRACT

An installation is provided for carrying out localized electrolytic surface treatment, of the type including an electrolyte reservoir (22) and pumping means (19) adapted for feeding the electrolyte to an anodic equipment (1) able to be placed in contact with the surface of the work piece (P) to be treated, a thin electrolyte flow space then being provided, in said equipment, between the surface of the anode (5) and said surface to be treated, the anode (5) and said work piece (P) being connected to the terminals of a DC voltage source, characterized in that it includes suction means (4, 25) connected to said equipment (1) for bringing the electrolyte back to said reservoir (22) after it has passed through said flow space.

6 Claims, 7 Drawing Sheets

INSTALLATION FOR CARRYING OUT LOCALIZED ELECTROLYTIC SURFACE TREATMENTS

The present invention relates to an installation for carrying out localized electrolytic surface treatments, of the type including a reservoir of electrolyte and pumping means adapted for feeding the electrolyte to anodic equipment able to be placed in contact with the surface of the work piece to be treated, a thin electrolyte flow space being then formed, in said equipment, between the surface of the anode and said surface to be treated, the anode and said work piece being connected to the terminals of a DC voltage source.

Such treatment by electrolysis may in particular be intended for obtaining on a selected zone of the work piece in question a preventive function with respect to wear or friction, corrosion or else electric conductivity phenomena. The surfaces concerned are situated on the functional zones of conducting parts (ferrous, copper metals, light alloys). In the case of such deposits, the anode is connected to the positive terminal of the DC voltage source and the work piece, forming the cathode, to the negative terminal of this source. The anode is irrigated by the selected solution. The electric circuit comes into action when the anode equipment is positioned on the surface to be treated.

Thus very adherent and very dense deposits are obtained in a short time, and with high precision. Such deposits may be formed from a few microns to a few tenths under conditions of perfect adhesion; they are characterized by porosities which are often zero and very accurate thickness checks (of the order of a micron).

The present invention relates to an installation for carrying out localized electrolytic surface treatments, of the type including a reservoir of electrolyte and pumping means adapted for feeding the electrolyte to anodic equipment able to be placed in contact with the surface of the work piece to be treated, a thin electrolyte flow space being then formed, in said equipment, between the surface of the anode and said surface to be treated, the anode and said work piece being connected to the terminals of a DC voltage source.

Such treatment by electrolysis may in particular be intended for obtaining on a selected zone of the work piece in question a preventive function with respect to wear or friction, corrosion or else electric conductivity phenomena. The surfaces concerned are situated on the functional zones of conducting parts (ferrous, copper metals, light alloys). In the case of such deposits, the anode is connected to the positive terminal of the DC voltage source and the work piece, forming the cathode, to the negative terminal of this source. The anode is irrigated by the selected solution. The electric circuit comes into action when the anode equipment is positioned on the surface to be treated.

Thus very adherent and very dense deposits are obtained in a short time, and with high precision. Such deposits may be formed form a few microns to a few tenths under conditions of perfect adhesion; they are characterized by porosities which are often zero and very accurate thickness checks (of the order of a micron).

More than 100 primary metals or binary or ternary alloys may be deposited. By way of example, among the primary metals: copper, nickel, cobalt, tin, cadmium, lead, zinc, silver, gold may be deposited. Binary alloys such as nickel-cobalt, nickel-tungsten are used. Ternary alloys such as nickel/tin/lead or nickel/tin/cadmium are perfectly adapted to selective deposition.

Excellent results are also obtained in the matter of anodic (chromic, hard, sulphuric or phosphoric) oxidization or electrolytic polishing, by using a reverse current, the anode then being replaced by the cathode.

However, in what follows and for the sake of simplicity, mention will only be made of installations used for making deposits, the equipment intended to come into contact with the surface of the work piece to be treated being then called "anodic equipment". It goes without saying however that the invention may be used, with the same essential characteristics and the same advantages, in anodic oxidization or electrolytic polishing installations.

In the present state of the technique, the electrolytic solution may be fed between the anode and the cathode by steeping the anode in a container containing the electrolyte, this latter then imbibing the envelope of the anode. The electrolyte may also be fed continuously between the anode and the cathode, by pumping.

In all cases, a system is provided for recovering the solution by means of a retention tank placed under the work piece to be treated, so that the operation is carried out in a closed circuit: the electrolyte already having served and being recovered in the tank is again taken up either by impregnation or by pumping.

Such a procedure avoids the loss of electrolyte, but has the drawback that the installation is inconvenient to use because of the presence of the retention tank, which greatly limits the mobility thereof. This is particularly troublesome when the work pieces to be treated are cumbersome or fixed, whether they are vertical or horizontal, for it is then the whole of the installation which must be moved.

The aim of the present invention is to overcome this drawback and to increase the mobility of the installation by doing away with the retention tank while still allowing the electrolyte to be recovered, whether the surfaces of the work pieces to be treated are horizontal or vertical.

For this, an installation of the general type mentioned at the beginning will, in accordance with the invention, be essentially characterized in that it comprises suction means connected to said equipment for bringing the electrolyte back to said reservoir after it has passed through said flow space.

Thus, the electrolyte will be immediately recovered after passing through the space formed between the surface of the anode and the surface of the work piece to be treated, without being able to leave the equipment, as long as said suction means are sufficiently powerful.

Different embodiments of the invention will now be described by way of examples which are in no wise limitative, with reference to the Figures of the accompanying drawings in which.

Figure 1:
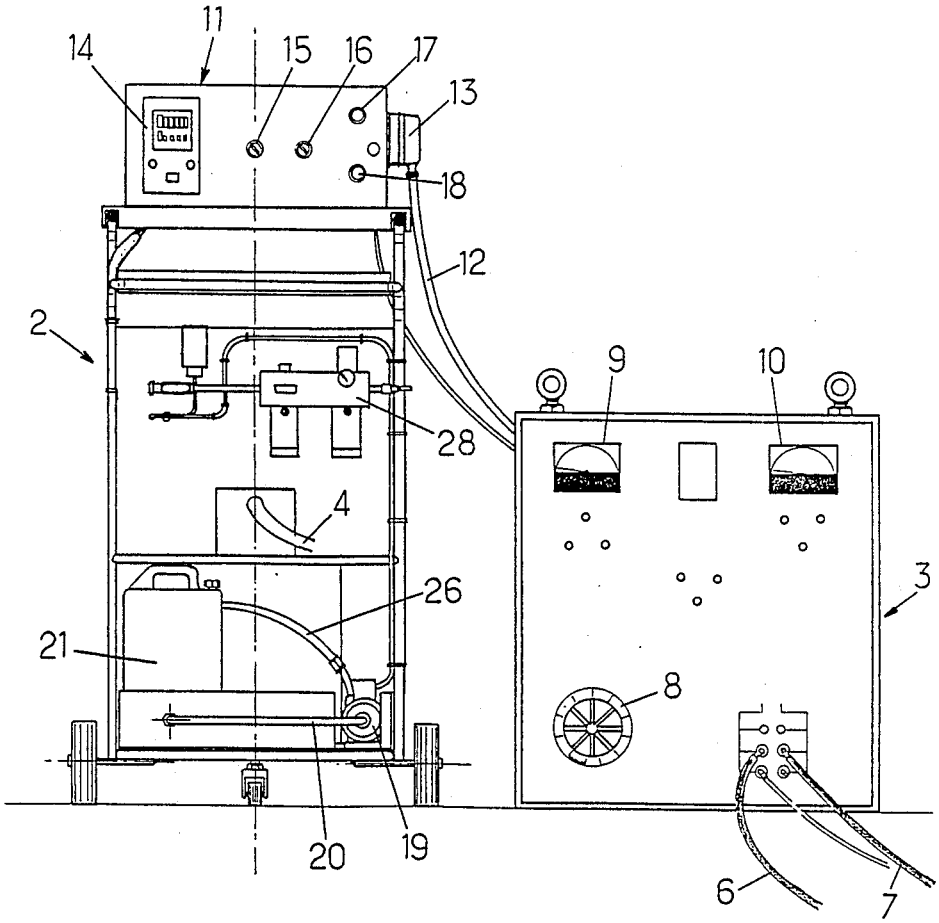
FIG. 1 is a schematical front elevational view of an installation in accordance with the invention, but not showing the anodic equipment.
Figure 2:
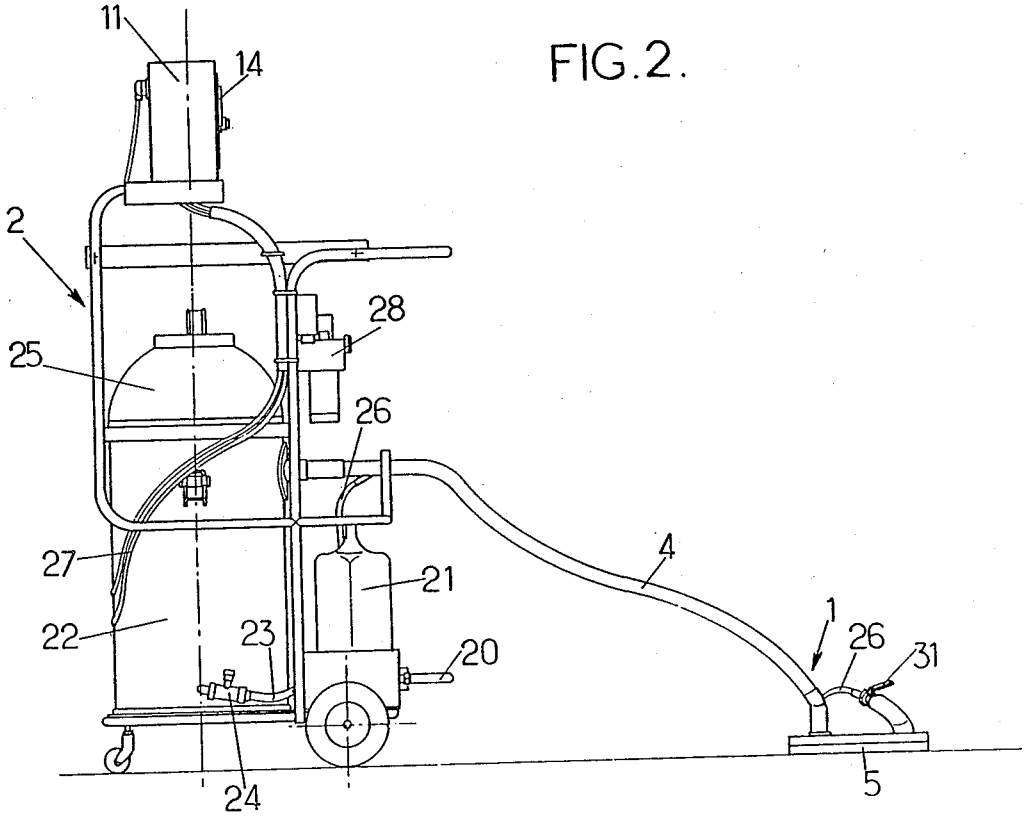
FIG. 2 is a side elevational view of this installation, further showing the anodic equipment.
Figure 3:
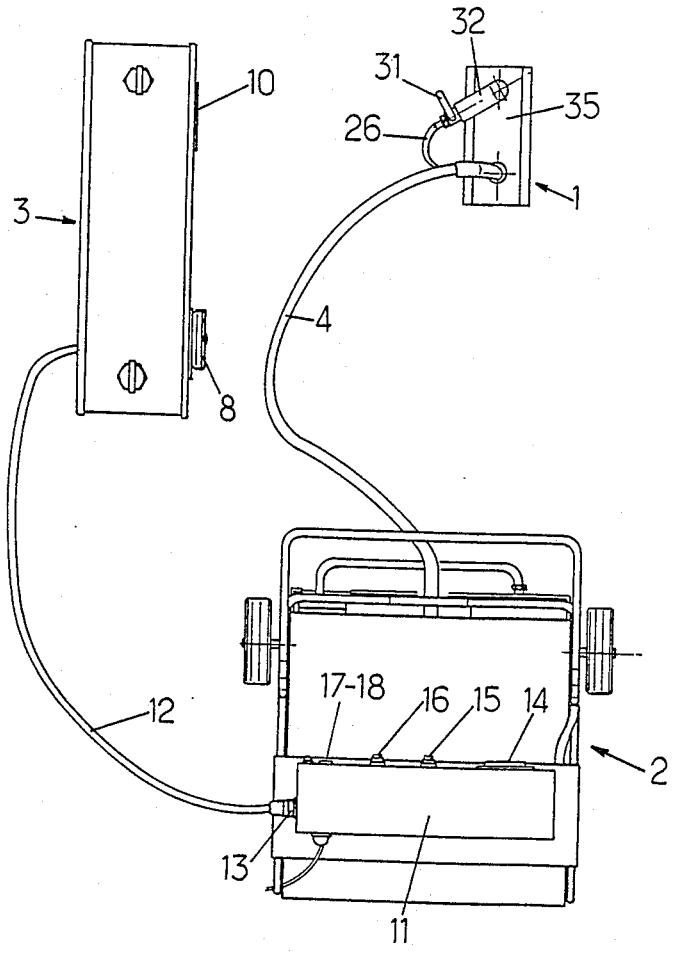
FIG. 3 is a top plan view of the installation.

In the installation shown schematically in FIGS. 1 to 3, the anodic equipment has been shown as a whole at 1 in FIGS. 2 and 3. On a mobile carrier referenced generally at 2 are disposed certain pieces of equipment required for the electrolytic treatment operations, this carrier being connected to the anodic equipment 1 by an electrolytic solution transport pipe, referenced at 4. In FIGS. 1 and 3, a power unit has further been shown generally referenced at 3, delivering the DC voltage required for the electrolysis operations and whose output terminals are connected on the one hand to the anode 5 (made for example from graphite) of the anodic equipment by means of a cable 6 and, on the other hand, to the work piece to be treated (not shown), which forms the cathode, by means of the cable 7. For the sake of simplicity, these cables have only been shown in FIG. 1. In this same Figure, a means has been shown at 8 for adjusting the electrolysis voltage, at 9 a voltmeter indicating a voltage delivered between cables 6 and 7 and at 10 an ammeter indicating the intensity of the electrolysis current.

As can be further seen in FIGS. 1 to 3, the mobile carrier 2 further includes an electric depression control box 11, connected to the power unit 3 by a cable 12 and a connector 13, this unit 11 being provided with a display diode 14 for counting the ampere-hours, and on/-off push buttons 15 for controlling the depression and 16 for controlling the pump. At 17 and 18 have been shown members for the on/off control of the power unit 13.

The pump, intended to supply the anodic equipment 1 with electrolytic solution, is carried by the carriage 2 and has been referenced 19. Its suction pipe 20 is connected to a buffer tank 32, itself connected to a main electrolytic solution reservoir 22 through a pipe 23 having an isolating valve 24.

At the top of reservoir 22 is disposed a turbine 25 adapted for creating therein a depression for the return of the electrolytic solution through pipe 4 from the anodic equipment 1.

As for the delivery output of pump 19, it is connected to the anodic equipment 1 by a feed tube 26 shown in FIGS. 1, 2, 3 and 6 and which passes inside the electrolytic solution transport pipe 4. For their power supply, pump 19 and the depression turbine 25 are connected to the electric box 11 by electric cables referenced at 27 in FIG. 2.

Furthermore, the carriage 2 also has an assembly referenced generally at 28 in FIGS. 1 and 2 providing a compressed air source for adapting equipment 1 as a pneumatic grinder when the coating has been formed. This is why, in FIGS. 5 and 6, a pneumatic vibrator has been shown at 29 adapted to be controlled by a handle 30 for subjecting the anodic equipment 1 to vibrations, either during the electrolysis operation, or after this operation, which then allows grinding to be carried out after disposing an abrasive material in the interface between said equipment 1 and the treated work piece. It should be noted that, when the vibrations are used during the electrolysis operation, they improve the quality of the deposition and in particular prevent pitting from appearing which could otherwise appear.

The anodic equipment 1 will now be described in greater detail.

Figure 4:
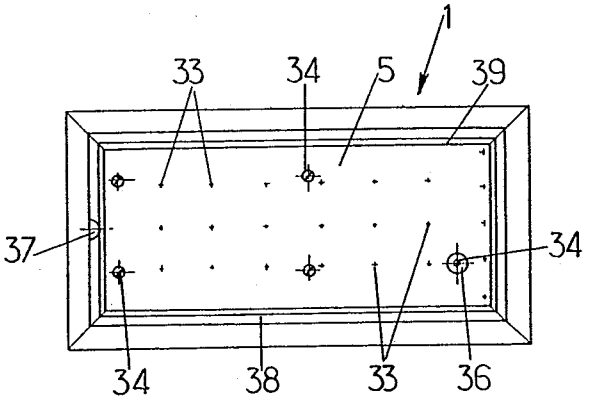
FIGS. 4, 5 and 6 are respectively bottom views in front elevation and in side elevation of one embodiment of anodic equipment provided with a pneumatic vibrator.

We saw above that the anodic equipment 1 is fed with electrolytic solution through a feed tube 26. This tube is of a relatively small diameter, so that it may pass through the transport pipe 4 through the whole of its length. Equipment 1 comprises on this tube 26 an opening and closing valve for the electrolyte feed. Downstream of this valve 31, tube 26 passes through a thicker tube 32 forming at the same time a handle. The electrolytic solution arriving at equipment 1 through tube 32 penetrates under the graphite anode 5, which has the general form of a rectangular plate, while being distributed over the whole surface of the underneath side of the anode and it passes therethrough through a multiplicity of fine passages referenced 33 in FIG. 4. The electrolyte is thus in contact with the work piece to be coated by the whole of the surface of the anode 5. In FIG. 4, at 34 screws have also been shown for fixing the anode 5 to the case 35 of equipment 1 and at 36 an electric contact terminal connected to the end of cable 6. At 37, in the bottom view of FIG. 4, a suction opening has been shown in connection with the end of the transport tube 4 which, as mentioned above, allows the electrolytic solution to return to the main reservoir 22. This suction opening 37 is situated at the bottom of a suction groove 38 surrounding the anode 5, with interpositioning of a peripheral insulating material 39. Thus, the whole of the electrolyte coming from the fine passages 33 cannot escape to the outside of the anodic equipment 1, since on each of the sides of the anode it is sucked into the peripheral groove 38, in which a depression is created because of its communication with the suction opening 37.

It can thus be seen that the invention offers the great advantage of not requiring the use of a retention tank disposed under the anodic equipment 1; this equipment is therefore much easier to handle and horizontal or vertical surfaces which may be of any dimensions can be conveniently treated. It may for example be a question of vehicle bodies, but many other fields of application may be envisaged, such for example as in the aeronautic field, in the field of nuclear industry, electricity, etc.

Figure 6:
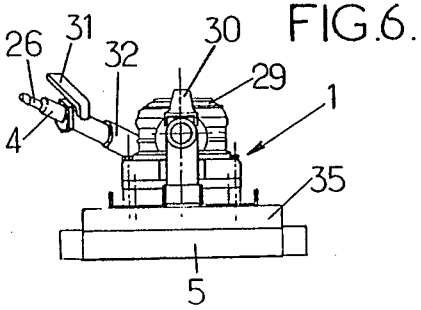
Figure 5:
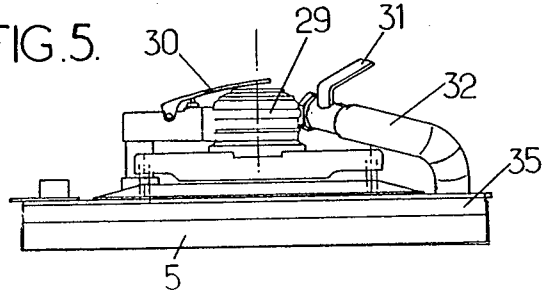
Figure 7:
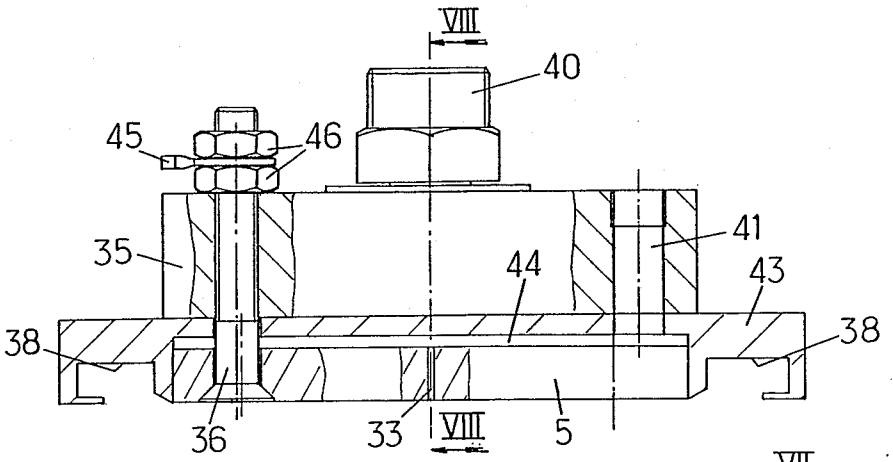
FIG. 7 is a sectional view of an anodic equipment alone through line VII—VII of FIG. 8.
Figure 8:
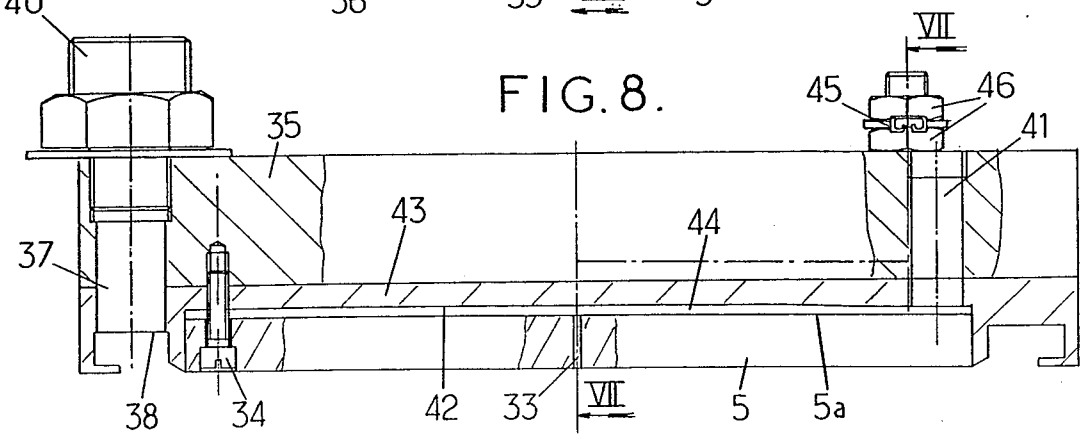
FIG. 8 is a sectional view through line VIII—VIII of FIG. 7.

In the sectional views shown in FIGS. 7 and 8, the same references have been used as much as possible as in FIGS. 4, 5 and 6 for designating the same parts of the anodic equipment or similar parts. the particular shape of the section of the suction groove 38 can be clearly seen in these Figures. The suction opening 37 which opens into the bottom suction groove 38 communicates with a suction tapping 40 which may be connected to the transport pipe 4.

In these two Figures, there has been further shown at 41 a passage to which the feed tube 32 may be connected and which passes through the case 35 of the equipment to emerge in the vicinity of the lower surface 5*a* of anode 5. It can be seen that between this surface 5*a* and the surface 42 of an isolating fixing piece 43 there is formed a space 44 for the electrolyte. It is because of this space that the electrolyte may be distributed over the whole of the surface of the anode 5 and consequently pass through this anode through the assembly of fine passages 33.

Finally, at 45 has been shown a current intake terminal tag 45 to which cable 6 may be connected and which is an electric connection with anode 5 through the electric contact terminal 36 whose threaded end receives two nuts 46 against which tag 45 is clamped.

Figure 9:
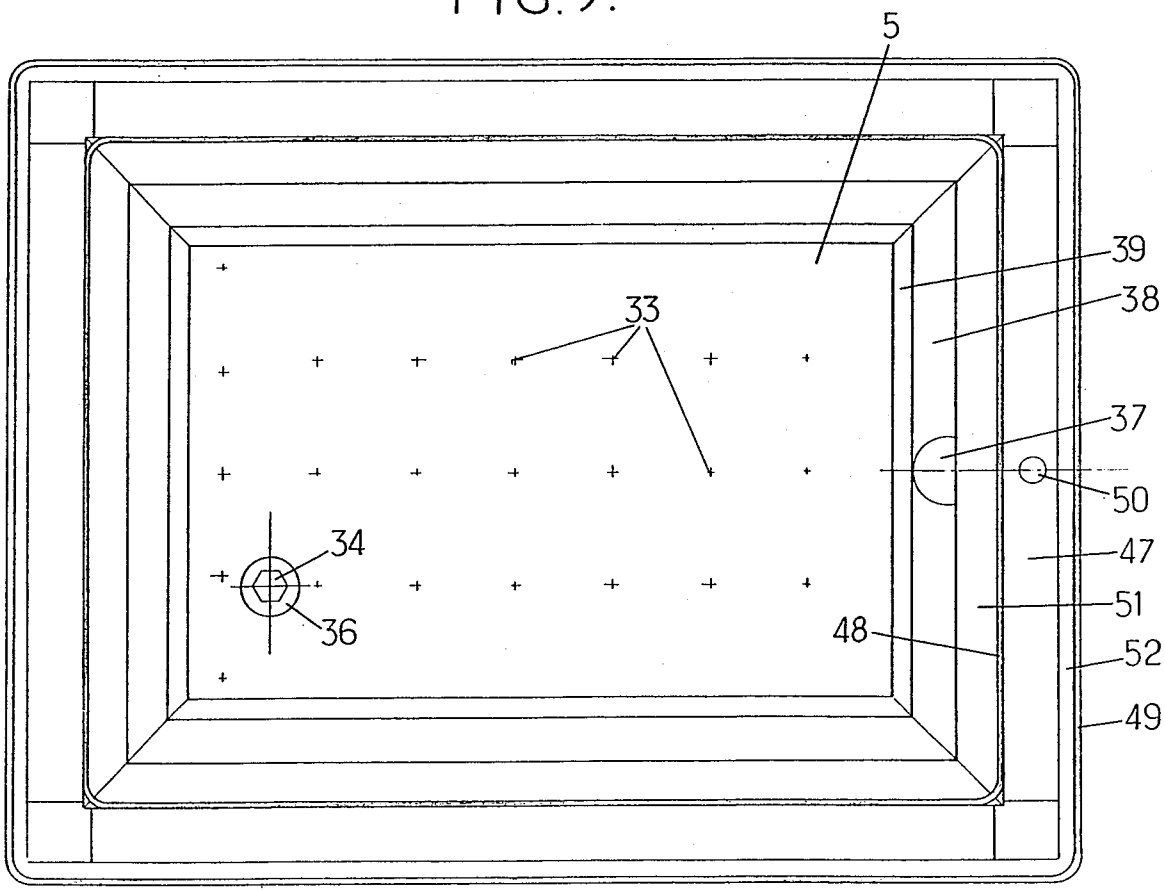
FIG. 9 is an enlarged bottom view of another embodiment of the anodic equipment.
Figure 10:
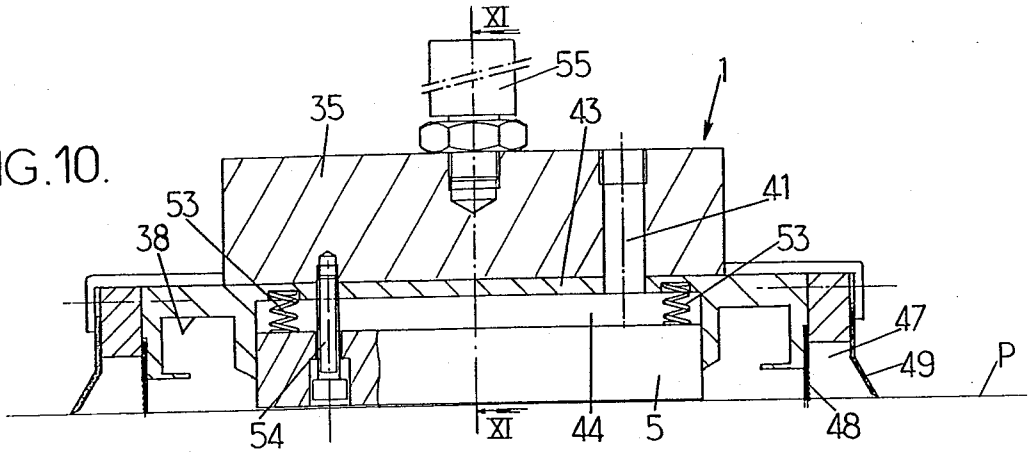
FIG. 10 is a sectional view of the anodic equipment of FIG. 9 through line X—X of FIG. 9.
Figure 11:
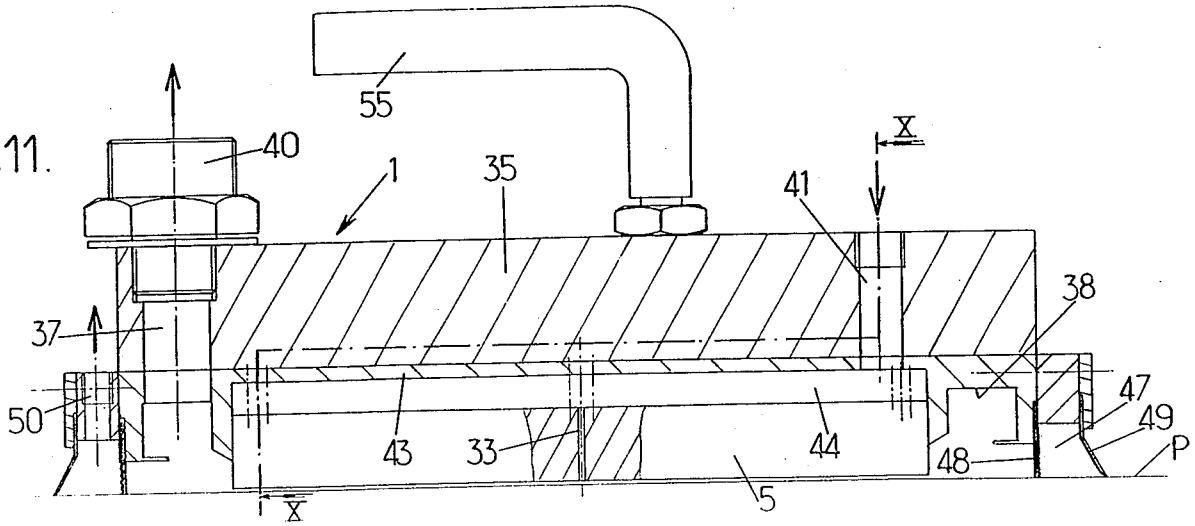
FIG. 11 is a sectional view through line XI—XI of FIG. 10.

FIGS. 9 to 11 show a variant of construction of the anodic equipment 1. Hereagain, the same references have been used as much as possible as above for designating the same parts of the equipment or similar parts or fulfilling the same role.

In this embodiment, anode 5 is again surrounded by a suction groove 38 into the bottom of which opens the suction opening 37, this groove being separated from the anode by the peripheral insulating material, for example a plastic material 39. The operation of this equipment will consequently be quite similar to that of the embodiment of FIGS. 4 to 6.

However, an additional peripheral space 47 has been provided defined by an internal skirt 48 and an external skirt 49 whose lips, forming crushed seals, are intended to be sealingly in contact with the work piece to be coated (shown schematically at P in FIGS. 10 and 11). The peripheral space 47 communicates with a suction tapping 50 (see FIGS. 9 and 11) and may thus be evacuated, so as to obtain a suction cup effect further reducing the risk of the electrolyte escaping outside the anodic equipment 1. In FIG. 9, there have been shown at 51 and 52 two plastic material or similar surrounds, respectively inside skirts 48 and 49.

In FIGS. 10 and 11, an elastic suspension of anode 5 has been shown through the interpositioning of an assembly of compressed springs 53 between anode 5 and the isolating fixing part 43.

Anode 5 may then be guided by rods such as 54. With this arrangement, a certain axial mobility is obtained for the anode, which compensates more particularly for the wear thereof and allows a very small space to be obtained permanently between part P and the surface of the anode.

As for reference 55, it designates a gripping handle.

It should be noted that in an additional variant of the anodic equipment 1, the above mentioned suction cup effect could be suppressed by suppressing the external skirt, but while maintaining the internal skirt 48 so as to increase sealing between part P and the peripheral suction groove 38.

I claim:

1. Installation for carrying out localized electrolytic surface treatment of a workpiece, of the type including an electrolyte reservoir (22) and pumping means (19) adapted for feeding the electrolyte to an anodic equipment (1) able to be placed in contact with a surface of said workpiece (P), a thin electrolyte flow space then being formed, in said equipment, between the surface of the anode (5) and said workpiece (P) being connected to the terminals of a DC voltage source (3), characterized in that it comprises suction means (4, 25) connected to said equipment (1) for brining the electrolyte back to said reservoir (22) after it has passed through said flow space, said anodic equipment (1) includes immediately adjacent to the periphery of said anode (5) a suction groove (38) into the bottom of which opens a suction opening (37) in communication, through a transport pipe (4), with said reservoir (22), the upper part thereof being equipped with a depression turbine (25) ensuring return of the solution, and said anodic equipment (1) is provided with means adapted for subjecting it to vibrations, particularly a pneumatic vibrator (29).

2. Installation according to claim 1, characterized in that the anode (5) is suspended resiliently in the case (35) of the anodic equipment (1).

3. Installation for carrying out localized electrolytic surface treatment of a workpiece, of the type including an electrolyte reservoir (22) and pumping means (19) adapted for feeding the electrolyte to an anodic equipment (1) able to be placed in contact with a surface of said workpiece (P), a thin electrolyte flow space then being formed, in said equipment, between the surface of the anode (5) and said workpiece (P) being connected to the terminals of a DC voltage source (3), characterized in that it comprises suction means (4, 25) connected to said equipment (1) for brining the electrolyte back to said reservoir (22) after it has passed through said flow space, said anodic equipment (1) includes immediately adjacent to the periphery of said anode (5) a suction groove (38) into the bottom of which opens a suction opening (37) in communication, through a transport pipe (4), with said reservoir (22), the upper part thereof being equipped with a depression turbine (25) ensuring return of the solution, and said anodic equipment comprises about the anode (5) a preipheral space (47) defined by two skirts (48, 49), whose lips are intended to be placed in sealing contact with the work piece to be treated (P), this space (47) being connectable to a suction tapping so as to be placed under depression and thus to subject the equipment (1) to a suction cup effect.

4. Installation for carrying out localized electrolytic surface treatment of a workpiece, of the type including an electrolyte reservoir (22) and pumping means (19) adapted for feeding the electrolyte to an anodic equipment (1) able to be placed in contact with a surface of said workpiece (P), a thin electrolyte flow space then being formed, in said equipment, between the surface of the anode (5) and said workpiece (P) being connected to the terminals of a DC voltage source (3), characterized in that is comprises suction means (4, 25) connected to said equipment (1) for brining the electrolyte back to said reservoir (22) after it has passed through said flow space, said anodic equipment (1) includes immediately adjacent to the periphery of said anode (5) a suction groove (38) into the bottom of which opens a suction opening (37) in communication, through a transport pipe (4), with said reservoir (22), the upper part thereof being equipped with a depression turbine (25) ensuring return of the solution, and further characterized in that the anode (5) has passing therethrough an assembly of fine passages (33) for the flow of the electrolyte from a space (44) formed between the anode and the bottom (43) of the case (35) of the equipment (1).

5. Installation for carrying out localized electrolytic surface treatment of a workpiece, of the type including an electrolyte reservoir (22) and pumping means (19) adapted for feeding the electrolyte to an anodic equipment (1) able to be placed in contact with a surface of said workpiece (P), a thin electrolyte flow space then being formed, in said equipment, between the surface of the anode (5) and said workpiece (P) being connected to the terminals of a DC voltage source (3), characterized in that it comprises suction means (4, 25) connected to said equipment (1) for brining the electrolyte back to said reservoir (22) after it has passed through said flow space, said anodic equipment (1) includes immediately adjacent to the periphery of said anode (5) a suction groove (38) into the bottom of which opens a suction opening (37) in communication, through a transport pipe (4), with said reservoir (22), the upper part thereof being equipped with a depression turbine (25) ensuring return of the solution, and further characterized in that the electrolyte reservoir (22), the suction means (25) and an electric control box (11) are carried by a mobile carriage (22) connected on the one hand to the anodic equipment (1) and on the other to a power unit (3).

6. Installation for carrying out localized electrolytic surface treatment of a workpiece, of the type including an electrolyte reservoir (22) and pumping means (19) adapted for feeding the electrolyte to an anodic equipment 91) able to be placed in contact with a surface of said workpiece (P), a thin electrolyte flow space then being formed, in said equipment, between the surface of the anode (5) and said workpiece (P) being connected to the terminals of a DC voltage source (3), characterized in that is comprises suction means (4, 25) connected to said equipment (1) for bringing the electrolyte back to said reservoir (22) after it has passed through said flow space, said anodic equipment (1) includes immediately adjacent to the periphery of said anode (5) a suction groove (38) into the bottom of which opens a suction opening (37) in communication, through a transport pipe (4), with said reservoir (22), the upper part thereof being equipped with a depression turbine (25) ensuring return of the solution, and wherein the anodic equipment (1) is replaced by cathodic equipment, for use in anodic oxidization or electrolytic polishing.

* * * * *